United States Patent [19]

Frank

[11] Patent Number: 4,522,634

[45] Date of Patent: Jun. 11, 1985

[54] METHOD AND APPARATUS FOR AUTOMATIC REGULATION OF THE OPERATION OF AN ELECTROSTATIC FILTER

[75] Inventor: Werner Frank, Bergisch Gladbach, Fed. Rep. of Germany

[73] Assignee: Walther & Cie Aktiengesellschaft, Cologne, Fed. Rep. of Germany

[21] Appl. No.: 572,663

[22] Filed: Jan. 20, 1984

[30] Foreign Application Priority Data

Jan. 20, 1983 [DE] Fed. Rep. of Germany ..... 3301772

[51] Int. Cl.[3] ..... B03C 3/68

[52] U.S. Cl. ..... 55/2; 55/105; 55/136

[58] Field of Search ..... 55/2, 105, 136, 139, 55/146

[56] References Cited

U.S. PATENT DOCUMENTS

| | | | |
|---|---|---|---|
| 2,860,723 | 11/1958 | Wintermute | 55/105 |
| 4,218,225 | 8/1980 | Kirchhoff et al. | 55/105 X |
| 4,311,491 | 1/1982 | Bibbo et al. | 55/105 X |
| 4,354,860 | 10/1982 | Herklotz et al. | 55/105 |
| 4,410,934 | 10/1983 | Fathauer et al. | 55/105 X |

*Primary Examiner*—Kathleen J. Prunner

*Attorney, Agent, or Firm*—Peter K. Kontler

[57] ABSTRACT

The operation of one or more full-size electrostatic filters for removing solid impurities from gaseous carrier media is regulated automatically as a function of variations of breakdown potential of a miniature electrostatic filter which is installed in the path of the contaminated gaseous carrier medium. The regulation is such that the potential which is applied to the corona discharge electrode(s) of the full-size filter(s) is very close to but continuously below the breakdown potential. This eliminates the periods of idleness of the full-size filter(s) by preventing arcing because the applied potential does not reach the breakdown value at which the electrostatic field collapses.

15 Claims, 5 Drawing Figures

METHOD AND APPARATUS FOR AUTOMATIC REGULATION OF THE OPERATION OF AN ELECTROSTATIC FILTER

BACKGROUND OF THE INVENTION

The present invention relates to electrostatic filters in general, and more particularly to improvements in so-called high tension (ionic bombardment) filters. Still more particularly, the invention relates to improvements in a method and apparatus for automatically regulating the operation of high tension filters by regulating the potential which is applied to such filters.

In presently known high tension filters, the potential which is applied thereto is increased to reach the breakdown value and is thereupon reduced to a variable extent and for a variable interval of time to a value below the preceding breakdown value. Such operation is followed by a renewed increase of potential to the breakdown value. This is deemed to be advisable and advantageous because the electrical filter output can be regulated in a more satisfactory way to follow the varying breakdown resistance of the gaseous carrier medium for solid impurities which require segregation from the carrier medium.

The operating potential of a high tension filter is invariably limited by spark discharge between the corona discharge electrode and the collecting electrode of the filter. As a rule, the filter potential is selected in such a way that some arcing in the filter will take place because the rate of separation (i.e., the separation efficiency) is then at a maximum value. On the other hand, the frequency of arcing should not be too high.

The aforediscussed prior filtering methods and apparatus exhibit the drawback that each arcing leads to a total collapse of the electric field and, by using modern operational switches (thyristors), each arcing is followed by a complete shutdown of the supply of potential for a period of a few half waves in order to avoid the initiation of an immediately ensuing follow-up arcing. This entails the development of breakdown times during which the charging does not take place in an optimum way and to an interruption of field forces which are required for separation.

OBJECTS AND SUMMARY OF THE INVENTION

An object of the invention is to provide a method of automatically regulating the potential which is applied to the electrodes of high tension filters in such a way that the periods of breakdown are eliminated, or that their duration reduced, in a simple and efficient way.

Another object of the invention is to provide a novel and improved apparatus for the practice of the above outlined method.

One feature of the invention resides in the provision of a method of regulating the application of electrical potential to a first high-tension electrostatic filter, particularly a filter which is used for the separation of solid particles from a gaseous carrier medium and wherein a first electrode is spaced apart from a second electrode of opposite polarity. The method comprises the steps of placing into the carrier medium a miniature second electrostatic high-tension filter, applying to one electrode of the second filter a potential which at least closely approximates the breakdown potential at which the electrostatic field between the electrodes of the second filter collapses, monitoring the potential which is applied to the second filter, and utilizing the monitored potential as a reference value for the application of potential to one electrode of the first filter so that the potential which is applied to the one electrode of the first filter closely approximates but is below the breakdown potential for the first filter.

The monitored potential can be used as a reference value for simultaneous application of potential to one electrode of at least one additional electrostatic filter whose breakdown potential greatly exceeds that of the second filter.

Another feature of the invention resides in the provision of an apparatus for separating solid particles from a gaseous carrier medium which is conveyed along a predetermined path. The apparatus comprises at least one first high-tension electrostatic filter having at least one pair of spaced-apart first and second electrodes of opposite polarity (such as a corona discharge electrode and a collecting electrode) which are disposed in the path of the carrier medium, a miniature second electrostatic filter having spaced-apart first and second electrodes whose mutual distance is preferably a fraction of the mutual distance of the electrodes of the first filter and which are also located in the path of the carrier medium, means (e.g., a transformer rectifier) for applying to one electrode of the second filter a potential which at least closely approximates the breakdown potential (at which the electrostatic field of the second filter collapses), and control means for applying to one electrode of the first filter a potential at least closely approximating but remaining below the breakdown potential for the first filter. The control means comprises a microprocessor or other suitable means for monitoring the potential which is applied to the one electrode of the second filter and for generating reference signals which are used to regulate the application of potential to the one electrode of the first filter as a function of fluctuations of potential which is being applied to the one electrode of the second filter. The apparatus can comprise two or more discrete first filters, and the second filter is preferably disposed between two first filters. A discrete source of potential is preferably provided for each first filter. The control means preferably comprises a discrete control unit for each first filter and cables and/or other suitable means for connecting the output of the microprocessor with each control unit, i.e., for transmitting signals from the microprocessor to the control units which, in turn, directly regulate the application of potential to the electrodes of the respective first units. The monitoring means can be arranged to monitor the potential which is applied to the one electrode of the second filter in an insulator compartment of a first filter or in the region of such compartment. The insulator compartment can be provided in or adjacent to a roof beam of a first filter. A portion of the path for the gaseous carrier medium can extend through the insulator compartment.

If the apparatus comprises several first filters, such first filters can be disposed in series and the second filter can be installed between two neighboring first filters. The series-connected first filters can be said to constitute discrete components of a composite first filter which comprises several pairs of first and second electrodes, one pair for each component of the composite first filter. The control means then comprises means for applying a variable potential to one electrode of each first filter or of each component of a composite first filter as a function of variations of monitored potential which is being applied to the one electrode of the second filter.

Alternatively, the second filter can be remote from the first filter or filters and can be arranged to separate solid particles from the gaseous carried medium in a separate path. All that counts is to ensure that the monitoring of the potential which is applied to the one electrode of the second filter can be utilized for proper regulation of application of potential to the one electrode of each first filter in such a way that the potential which is applied to the one electrode of each first filter is close to but does not exceed the breakdown potential for the respective first filter.

The term "miniature" is intended to be interpreted in the broadest possible sense. Thus, the second filter can constitute a substantial apparatus but the distance between its electrodes is preferably a fraction of the distance between the electrodes of a first filter so that the breakdowns which take or can take place during operation of the second filter are of no significance insofar as the separating action is concerned. For example, the breakdown potential for the second filter can be in the range of 10,000 volts whereas the breakdown potential for a first filter is many times such potential (e.g., in the region of 80,000 volts).

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
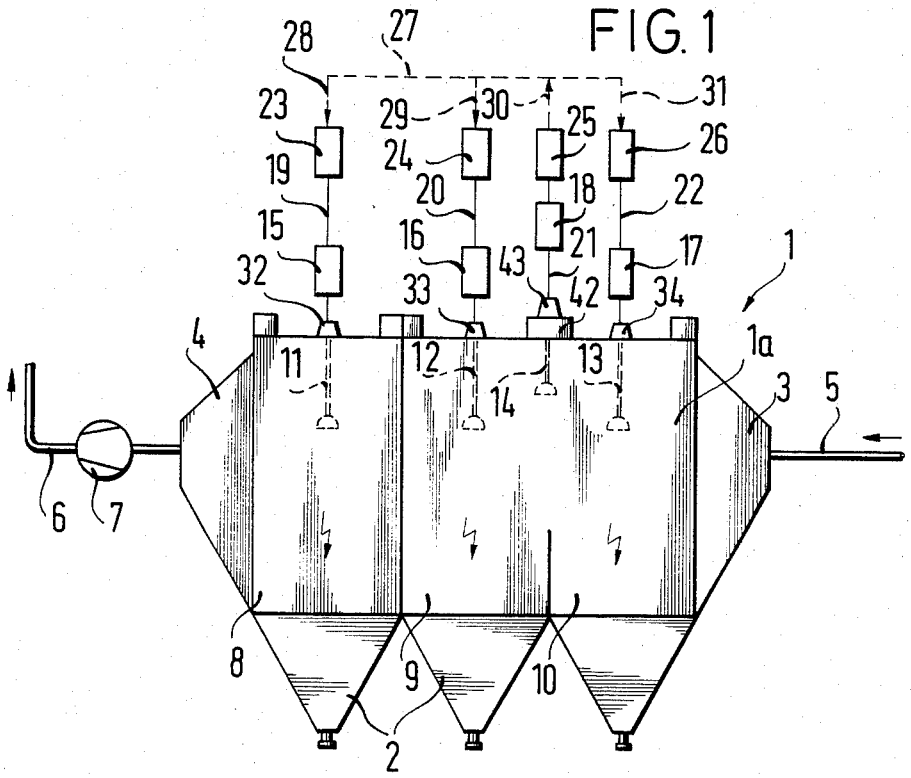
FIG. 1 is a schematic vertical sectional view of a three-zone filter which embodies the invention.

The electrofilter 1 of FIG. 1 comprises a housing 1*a* with three collecting vessels 2 at its lower end. Furthermore, the housing 1*a* comprises a gas inlet 3 which receives contaminated gases from a supply conduit 5, and a gas outlet 4 which is connected with a conduit 6 for removal of purified gases. The conduit 6 contains a suction pump 7 which causes the gaseous carrier medium to flow from the conduit 5, through the housing 1*a* and into the conduit 6. The interior of the housing 1*a* is subdivided into three filtering zones 8, 9 and 10 which respectively contain corona discharge electrodes 11, 12 and 13.

Figure 2:
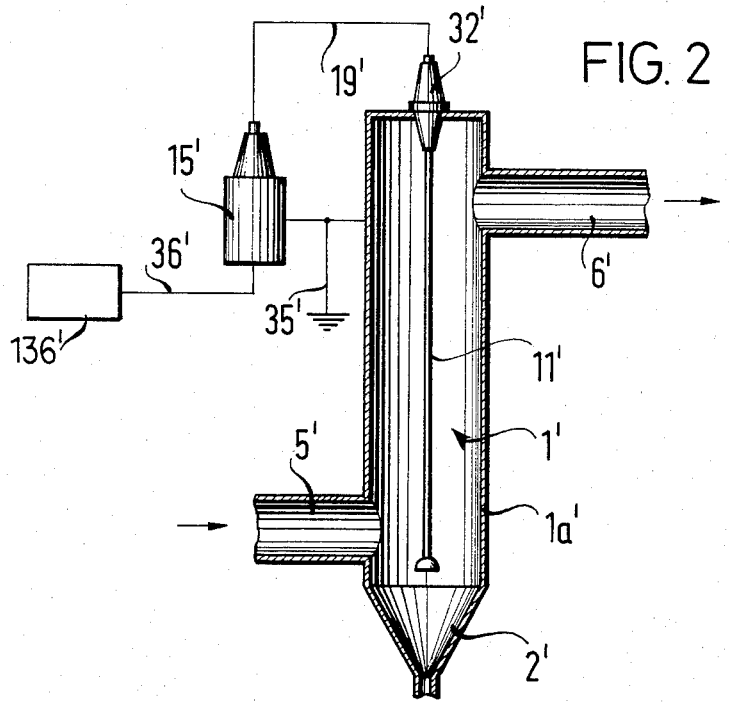
FIG. 2 is a schematic sectional view of a single filter.

FIG. 2 shows schematically the principle of operation of an electrofilter 1'. This filter comprises a tubular collecting electrode 1*a'* and a thin wire-like corona discharge electrode 11' of opposite polarity. In this embodiment, the corona current develops at the electrode 11' which is connected with the negative terminal of a high-voltage rectifier 15'. The reference numeral 19' denotes a high-voltage cable which connects the negative pole of the rectifier 15' with the electrode 11' and passes through an insulator 32' at the top of the housing of the filter 1'. The rectifier 15' is further connected with a source 136' of a-c current by way of a lead 36'. The collecting electrode 1*a'* is connected to the ground, as at 35'. Particles of dust in a gaseous carrier medium enter the collecting electrode 1*a'* (which is actually the housing of the filter 1') close to the lower end by way of a conduit 5' and are charged during the first stage of their travel through the electric field while covering a distance in the range of a few centimeters. The thus charged dust particles are propelled against the internal surface of the electrode 1*a'* under the action of the electric field. Separation of all dust particles from the admitted gaseous carrier medium merely requires an interval of between one and two seconds. The separated solid particles descend into the collecting vessel 2', and the purified gas leaves the housing or electrode 1*a'* via conduit 6'.

The basic circuitry, design and mode of operation of filters of the type to which the present invention pertains is fully disclosed in "Industrial Electrostatic Precipitation" by Harry J. White (1963, Chapter 7) published by Addison Wesley Publishing Co., Inc., Palo Alto, Calif.

Filters of the character shown in FIG. 2 can be of the single-stage or multi-stage type and each thereof can include a single filtering zone or several filtering zones. Referring again to FIG. 1, the corona discharge electrodes 11, 12, 13 in the zones 8, 9, 10 of the filter housing 1*a* are connected to discrete sources of high-voltage energy. Such sources are high-voltage transformer rectifiers 15, 16 and 17 which are respectively connected with the corresponding electrodes 11, 12, 13 by high-voltage cables 19, 20, 22. The cables 19, 20, 22 respectively pass through suitable insulators 32, 33 and 34 in the top portion of the housing 1*a*. The cables 19, 20, 22 further respectively pass through the control units 23, 24 and 26 which are provided with suitable control elements, not specifically shown. A common regulating line for the electrodes 11, 12 and 13 is shown at 27; this line has terminals 28, 29, 31 which are respectively connected with the control units 23, 24 and 26.

In accordance with a feature of the invention, the filter 1 further comprises a miniature filter 14 which is disposed in the region of an insulator compartment 42 between the zones 9, 10 and which also comprises two spaced-apart electrodes (namely a corona discharge electrode and a collecting electrode of opposite polarity), the same as the other filter zones. A high-voltage cable 21 extends through an insulator 43 to a high-voltage aggregate 18 and thence to the common regulating line 27 by way of terminal 30. The reference character 25 denotes a control unit in the cable 21 between the high-voltage aggregate 18 and the regulating line 27. The insulator compartment 42 is integrated into the roof beam of the housing 1*a*.

The rectifiers 15, 16, 17 may be of the type manufactured and sold by the West German firm AEG under the designation E 78000/0.9 CE-C0V6. The control units 23, 24 and 26 may be of the type FSR 62 (manufactured by AEG) or PCS (manufactured by Phillips). The rectifier 18 may be of the type E 10,000 (manufactured by AEG), and the control unit 25 may be a so-called Profimat microprocessor of the type known as Intel 8087 (manufactured by AEG). It will be noted that the maximum potential (10,000 volts) which is applied to the filter 14 may be a minute fraction of the maximum potential (78,000 volts) which is or can be applied to the full-size filters including the electrodes 11, 12 and 13.

Figure 3A:
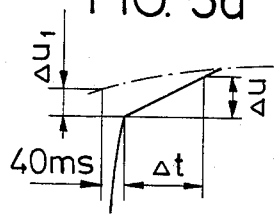
FIG. 3*a* is an enlarged view of a detail within the circle A in FIG. 3.
Figure 3:
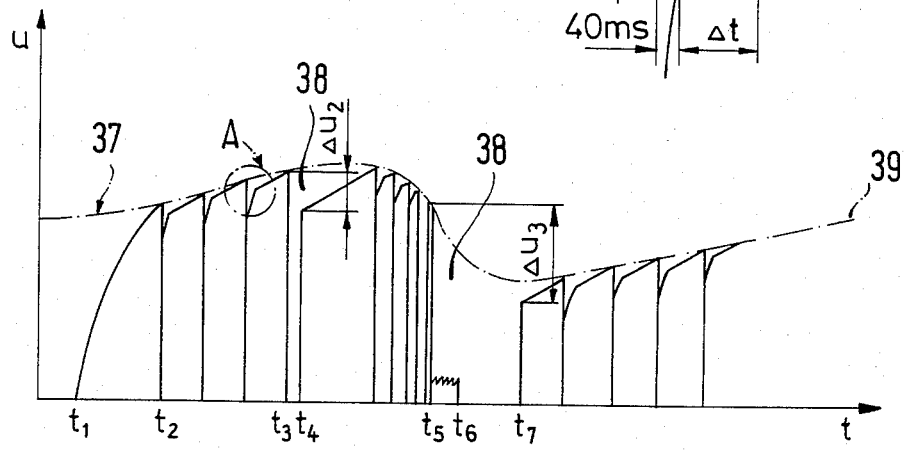
FIG. 3 is a graph showing the progress of the breakdown characteristic, periods of idleness and filter breakdown potentials in a conventional filter.

The diagram of FIG. 3 and the detail shown in FIG. 3*a* illustrate a conventional mode of regulating the operation of an electrofilter. The voltage (u) is measured along the ordinate and the time (t) is measured along the abscissa of the coordinate system. The phantom-line curve 37 denotes the breakdown characteristic and the characters 38 denote the periods of breakdown of operation (i.e., the periods of idleness) of the conventional filter. The curve 39 denotes the filter breakdown voltage. The additional reference characters which appear in FIG. 3 denote the following:

$t_1$=instant of starting the filter;

$t_2-t_1$=interval which elapses from start of operation to begin of normal operation of the filter;

$\Delta U/\Delta t$=selected rate of acceleration to normal operation;

$\Delta U_1$=reduction of potential following a spark or arc;

$t_4-t_3$=interval of interruption which takes place when the nominal current (Jn) is exceeded by 10 percent;

$\Delta U_2$=reduction of potential subsequent to exceeding 1.1 Jn;

$t_6-t_5$=duration of arc discharge;

$t_7-t_6$=interval of interruption subsequent to arcing;

$\Delta U_3$=reduction of potential following the arc.

Figure 4:
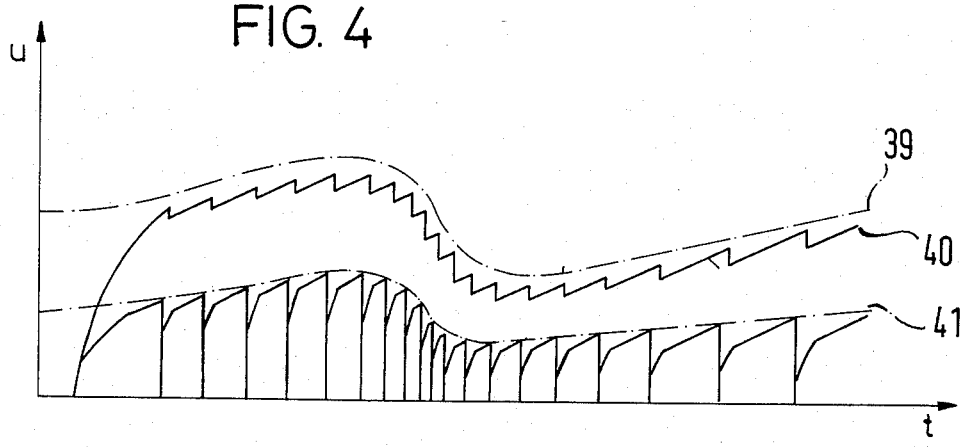
FIG. 4 is a graph wherein the curves denote the characteristics of the improved filter and its miniature component.

The upper part of the graph of FIG. 4 shows the progress of potential on application of the novel method with filter breakdown potential 39 and applied filter potential 40. The lower part of the graph of FIG. 4 shows the breakdown potential curve 41 for the miniature electrofilter. Here, too, a small reduction of output in the regulated electric field is clearly discernible. However, one totally avoids the field breakdowns (at 38 in FIG. 3) which seriously affect the quality and efficiency of separation in a conventional filter. The curve 41 fluctuates because the breakdown potential for the miniature filter 14 varies as a function of varying characteristics of the gaseous carrier medium and/or varying influence of solid particles in the carrier medium.

In order to properly calibrate the microprocessor which constitutes or forms part of the control unit 25, it is merely necessary to establish, for a given instant, the ratio of potentials which are denoted by the curves 40, 41 of FIG. 4 and to thereupon monitor the breakdown voltage for the miniature filter 14. The microprocessor then automatically conforms the actual potential (curve 40) for the full-size filters to the breakdown potential (curve 41) for the miniature filter.

It will be seen that the method of the present invention includes the step of providing a miniature electrofilter 14 which includes two electrodes having opposite polarities, and utilizing the miniature electrofilter 14 for regulating of the application of potential to the main (full-size or commercial) filter or filters. The miniature filter 14 can be installed at a suitable location (for example, below the aforementioned roof beam of the housing 1*a* at the inlet of the field to be regulated) and the control unit 25 is designed to continuously monitor the variable breakdown limit (curve 41 in FIG. 4). The arrangement is such that the miniature filter 14 takes into consideration not only the important influence of the gaseous carrier medium but also the influence of dust or other solid material which is to be separated from the gaseous carrier medium upon the breakdown limit. The miniature electrofilter is operated with low potential values (i.e., with electrodes placed at a short distance from one another) so that the developing arcing is insignificant.

The limits of potential for the high-voltage supply to the filter zones are achieved by resorting to a simple and inexpensive control, the continuously ascertained breakdown limit (curve 41) which is ascertained by the control unit 25 constituting the source of reference values for operation of the full-size filter or filters.

The improved filtering or precipitation method can be used with particular advantage when the breakdown limit necessarily undergoes pronounced fluctuations as a function of time. Thus, the method of the present invention can be used with advantage for removal of dust in power plants which operate with a variety of fuels and/or at variable loads, furnaces which burn brown coal, vapor filters for coal milling and drying plants, furnace dedusting plants in the cement industry with various modes of operation such as direct, compound and mixed operation, dedusting plants for garbage incinerator plants and a number of others. Furthermore, the method can be resorted to in connection with E-filters which are operated with ignitable and explosive media.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of regulating the application of electrical potential to a first high-tension electrostatic filter, particularly a filter which is used for the separation of solid particles from a gaseous carrier medium and wherein a first electrode is spaced apart from a second electrode of opposite polarity, comprising the steps of placing into the carrier medium a miniature second electrostatic filter; applying to one electrode of the second filter a potential which at least closely approximates the breakdown potential at which the electric field between the electrodes of the second filter collapses; monitoring the potential which is applied to the second filter; and utilizing the monitored potential as a reference value for the application of potential to one electrode of the first filter so that the potential which is applied to the one electrode of the first filter closely approximates but is below the breakdown potential.

2. The method of claim 1, further comprising the step of utilizing the monitored potential as a reference value for simultaneous application of potential to one electrode of at least one additional electrostatic filter whose breakdown potential greatly exceeds that of the second filter.

3. Apparatus for separating solid particles from a gaseous carrier medium which is conveyed along a predetermined path, comprising at least one first high-tension electrostatic filter having at least one pair of spaced-apart first and second electrodes of opposite polarity, said electrodes being in contact with the medium in said path; a miniature second electrostatic filter having spaced-apart first and second electrodes whose mutual distance is a fraction of the mutual distance of the electrodes of said first filter and which are located in said path; means for applying to one electrode of said second filter a potential at least closely approximating the breakdown potential at which the electric field of the second filter collapses; and control means for applying to one electrode of said first filter a potential at least closely approximating but remaining below the breakdown potential for the first filter, including means for monitoring the potential which is applied to the one electrode of said second filter.

4. The apparatus of claim 3, comprising at least two first filters, said second filter being disposed between said first filters.

5. The apparatus of claim 4, comprising a discrete source of potential for each of said first filters.

6. The apparatus of claim 3, wherein said monitoring means comprises a microprocessor.

7. The apparatus of claim 6, wherein said control means further comprises a control unit for said first filter and means for transmitting signals from said microprocessor to said control unit.

8. The apparatus of claim 3, wherein said first filter further comprises an insulator compartment and said monitoring means is arranged to monitor the potential which is applied to the one electrode of said second filter in or in the region of said compartment.

9. The apparatus of claim 8, wherein a portion of the path for gaseous carrier medium extends through said compartment.

10. The apparatus of claim 3, comprising a plurality of first filters which are disposed in series, said control means including means for applying a variable potential to one electrode of each of said first filters as a function of variations of monitored potential which is applied to said second filter.

11. The apparatus of claim 3, wherein said one electrode of each of said filters is a corona discharge electrode.

12. The apparatus of claim 3, wherein the other electrode of each of said filters is a collecting electrode.

13. The apparatus of claim 3, comprising a plurality of first filters and a discrete source of potential for each first filter, said second filter being disposed between two first filters and said control means comprising a discrete control unit for each of said first filters, said monitoring means further comprising a microprocessor having an output and conductor means connecting said output with said control units.

14. The apparatus of claim 3, wherein said second filter is remote from said first filter.

15. The apparatus of claim 3, wherein said first filter comprises several discrete pairs of first and second electrodes and a discrete source of potential for one electrode of each of said pairs.

* * * * *